US009186539B2

(12) United States Patent
Kahmann et al.

(10) Patent No.: US 9,186,539 B2
(45) Date of Patent: Nov. 17, 2015

(54) WALKING SLIDE MILL

(71) Applicants: Paul G. Kahmann, Bloomington, MN (US); Adam M. Roussopoulos, Bloomington, MN (US)

(72) Inventors: Paul G. Kahmann, Bloomington, MN (US); Adam M. Roussopoulos, Bloomington, MN (US)

( * ) Notice: Subject to any disclaimer, the term of this patent is extended or adjusted under 35 U.S.C. 154(b) by 80 days.

(21) Appl. No.: 14/202,580

(22) Filed: Mar. 10, 2014

(65) Prior Publication Data

US 2015/0111702 A1 Apr. 23, 2015

Related U.S. Application Data

(62) Division of application No. 29/470,086, filed on Oct. 17, 2013, now Pat. No. Des. 723,636.

(51) Int. Cl.
*A63B 22/04* (2006.01)

(52) U.S. Cl.
CPC ..... *A63B 22/04* (2013.01)

(58) Field of Classification Search
None
See application file for complete search history.

(56) References Cited

U.S. PATENT DOCUMENTS

| | | | | |
|---|---|---|---|---|
| 1,766,089 | A | 6/1930 | Wood | |
| 2,842,365 | A * | 7/1958 | Kelley | 482/51 |
| 3,608,898 | A | 9/1971 | Berlin | |
| 3,637,206 | A | 1/1972 | Chickering, III | |
| 3,642,279 | A | 2/1972 | Cutter | |
| 3,669,238 | A | 6/1972 | Folkes et al. | |
| 4,757,987 | A | 7/1988 | Allemand | |
| 5,232,419 | A | 8/1993 | Kozak | |
| 5,709,632 | A * | 1/1998 | Socwell | 482/54 |
| 6,095,952 | A | 8/2000 | Ali et al. | |
| 6,740,009 | B1 | 5/2004 | Hall | |
| 7,008,352 | B2 | 3/2006 | Grossi | |
| 7,510,511 | B2 | 3/2009 | von Detten | |
| 7,922,626 | B2 | 4/2011 | Larson | |
| 8,343,016 | B1 | 1/2013 | Astilean | |
| 2012/0138763 | A1 * | 6/2012 | Russell | G03B 17/561 248/310 |
| 2014/0080679 | A1 * | 3/2014 | Bayerlein et al. | 482/54 |

* cited by examiner

*Primary Examiner* — Stephen Crow
(74) *Attorney, Agent, or Firm* — Gerald E. Helget; Briggs and Morgan, P.A.

(57) ABSTRACT

A reversible walking slide mill for a person seeking walking or jogging exercise has first and second plastic molded slide mill platforms horizontally interlockable to each other in side by side arrangement as for one platform for each person's foot. The platforms are disconnectable as to reduce width when in storage or transportation. A smooth slippery foot sliding surface is on top of each platform having an uphill inclined front surface and a rear surface shorter than the front surface with a flat surface therebetween. A pair of extensible rotatable gripping handles are mounted to each of the platforms for gripping and rotating by the person during exercise. Resilient feet on the bottom of the platforms provide vertical shock absorption, flexibility and recoil independently to each platform when a person is exercising on the slide mill platforms.

29 Claims, 6 Drawing Sheets

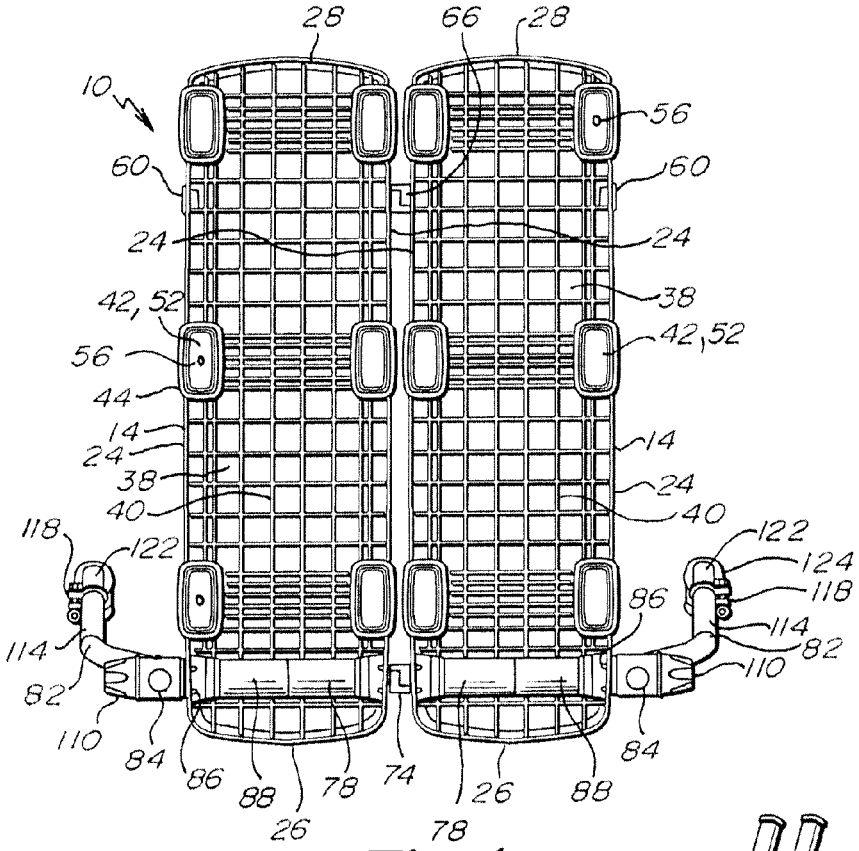
Fig. 4
Fig. 3A
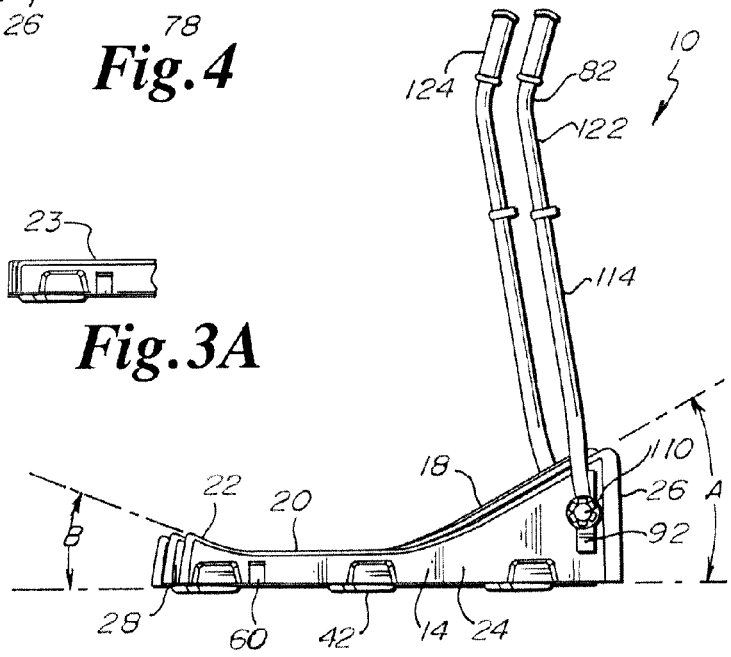
Fig. 3

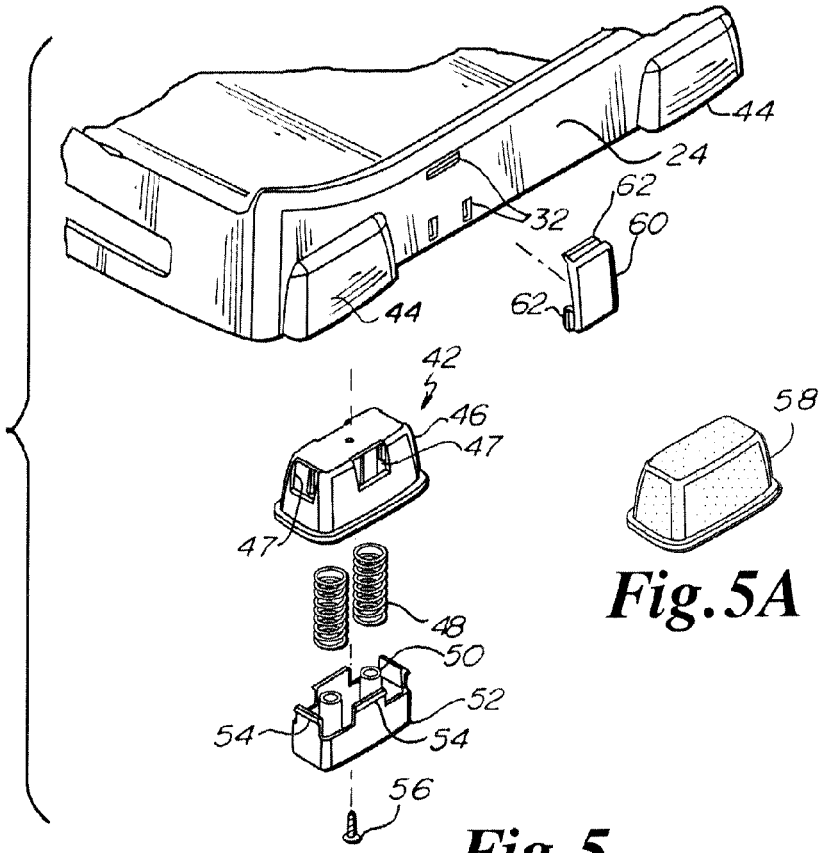
Fig.5A
Fig.5
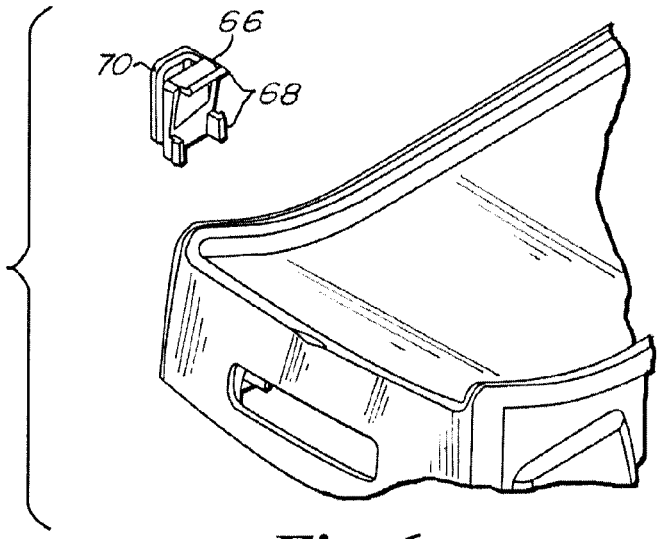
Fig.6

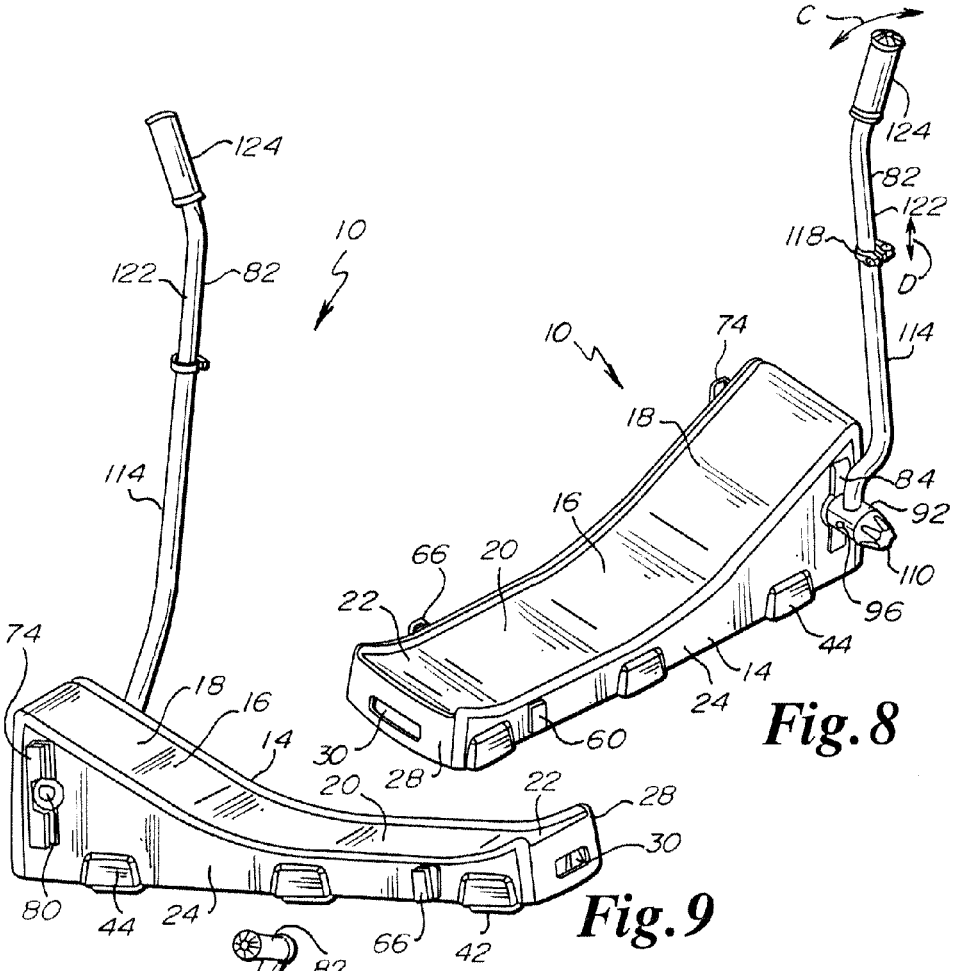
Fig. 8
Fig. 9
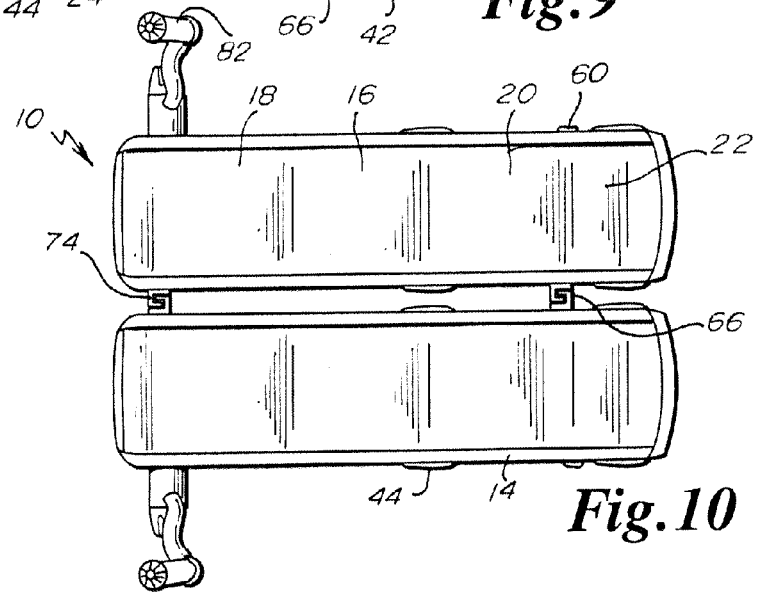
Fig. 10

WALKING SLIDE MILL

CROSS-REFERENCE TO RELATED APPLICATIONS

The present invention is a divisional of U.S. Design patent application Ser. No. 29/470,086 which was filed on Oct. 17, 2013.The contents of this application is incorporated herein by reference in its entirety.

BACKGROUND OF THE INVENTION

The present invention relates to walking, jogging and exercising apparatus for home use, and more particularly, to an inexpensive reversible walking slide mill that offers at least two walking or jogging exercise routines in a comfortable fashion that is light weight, has a small foot print and is collapsible for easy storage.

Tread mills are well known and expensive. Tread mills allow people to walk, jog, run and sprint on a stationary machine typified with an endless driven belt moving over a set of transverse parallel pulleys or rollers. Tread mills allow the users to exercise inside and unexposed to harsh elements outside in inclement weather. Additionally, tread mills allow users to exercise in the privacy of their own home while perhaps watching television, listening to the radio or even reading.

Tread mills require electricity to drive motors that rotate conveyors upon which a person may walk or jog. With the drive motors off, the conveyor or belt will not move due to friction. The conveyors are often elevatable and adjustable in speed. These tread mills are heavy and require a large horizontal and vertical foot print for operation. They do not lend themselves to easy movement about a dwelling, are generally not collapsible with rigid handles and do not easily storage out of sight when not in use. Treat mills also require maintenance for the motors, rollers, bearing and conveyor adjustments.

Non-motorized treat mills have generally not been commercially successful. While these types of tread mill may be less expensive due to the lack of motors, they are more difficult to operate requiring the user to shift forwardly and rearwardly his center of gravity as to drive and stop the conveyor. Alternatively, the conveyor must be inclined and designed to move under the feet of the user. They also may require elaborate bearing systems and fly wheels to minimize drag and friction as to allow the user to steadily drive the belt.

At least one slide mill in known in U.S. Pat. No. 2,842,365. This slide mill is of a general box-like construction and generally of a U-shape or concave half cylinder from a side view that requires a properly selected lubricant, such as powdered Borax. Fixed forwardly mounted handles are utilized. Front to rear grooves are utilized to try to prohibit the feet from sliding off the box. This slide mill is still bulky with rigid handles and has generally been undesirable.

There is a need for an inexpensive light-weight, molded plastic reversible slide mill with adjustable handles that offers two slippery walking terrains, adjustable moving handles, offers isolated and safe foot paths for each foot, independent shock absorption for each foot, and is readily collapsible for easy shipping, storage or transportation.

SUMMARY OF THE INVENTION

A reversible walking slide mill for a person seeking walking or jogging exercise has first and second plastic molded slide mill platforms horizontally interlockable to each other in side by side arrangement as for one platform for each person's foot. The platforms are disconnectable as to reduce width when in storage or transportation. A smooth slippery foot sliding surface is on top of each platform having an uphill inclined front surface and a rear surface shorter than the front surface with a flat surface therebetween. A pair of extensible rotatable gripping handles are mounted to each of the platforms for gripping and rotating by the person during exercise. Resilient feet on the bottom of the platforms provide vertical shock absorption, flexibility and recoil independently to each platform when a person is exercising on the slide mill platforms.

A principle object and advantage of the present invention is that it is a reversible walking slide mill that is inexpensive and light weight being molded from plastic as to easily move around and store when not in use.

Another object and advantage of the invention is that it is reversible offering two terrains for two types of muscle group exercises on one slide mill.

Another object and advantage of the invention is that it is has adjustable handles lengthwise that rotate to and fro on the slide mill with adjustable resistive settings for walking on the slide mill toward the front end or rear end.

Another object and advantage of the invention is that it is that the slide mill offers isolated and safe foot paths for each foot as to assist in avoiding a fall off the slide mill.

Another object and advantage of the invention is that it is the slide mill has independent shock absorption for each foot for smooth walking or jogging exercises.

Another object and advantage of the invention is that it is readily collapsible or disassembled for easy shipping, storage and transportation.

BRIEF DESCRIPTION OF THE DRAWINGS

FIG. 3 is a right side elevational view of the slide mill.

FIG. 3A is a broken away right side elevational view showing a relatively flat rear foot sliding portion.

FIG. 4 is a bottom plan view of the slide mill.

FIG. 5 is a rear perspective partially broken away view of the slide mill rear portion with the foot assembly in exploded view and in position below the slide mill and the rear plug or cap in position for securement to the outside of one of the platforms.

FIG. 5A is a perspective view of a foam rubber one-piece shock absorbing foot.

FIG. 6 is a rear perspective partially broken away view of the slide mill rear portion with the rear platform interlock in position for securement to the inside sidewall of one of the platforms.

FIG. 8 is an outside perspective view of the right platform fully assembled.

FIG. 9 is an inside perspective view of the right platform fully assembled.

FIG. 10 is a top plan view of the assembled slide mill.

DETAILED SPECIFICATION

Figure 1:
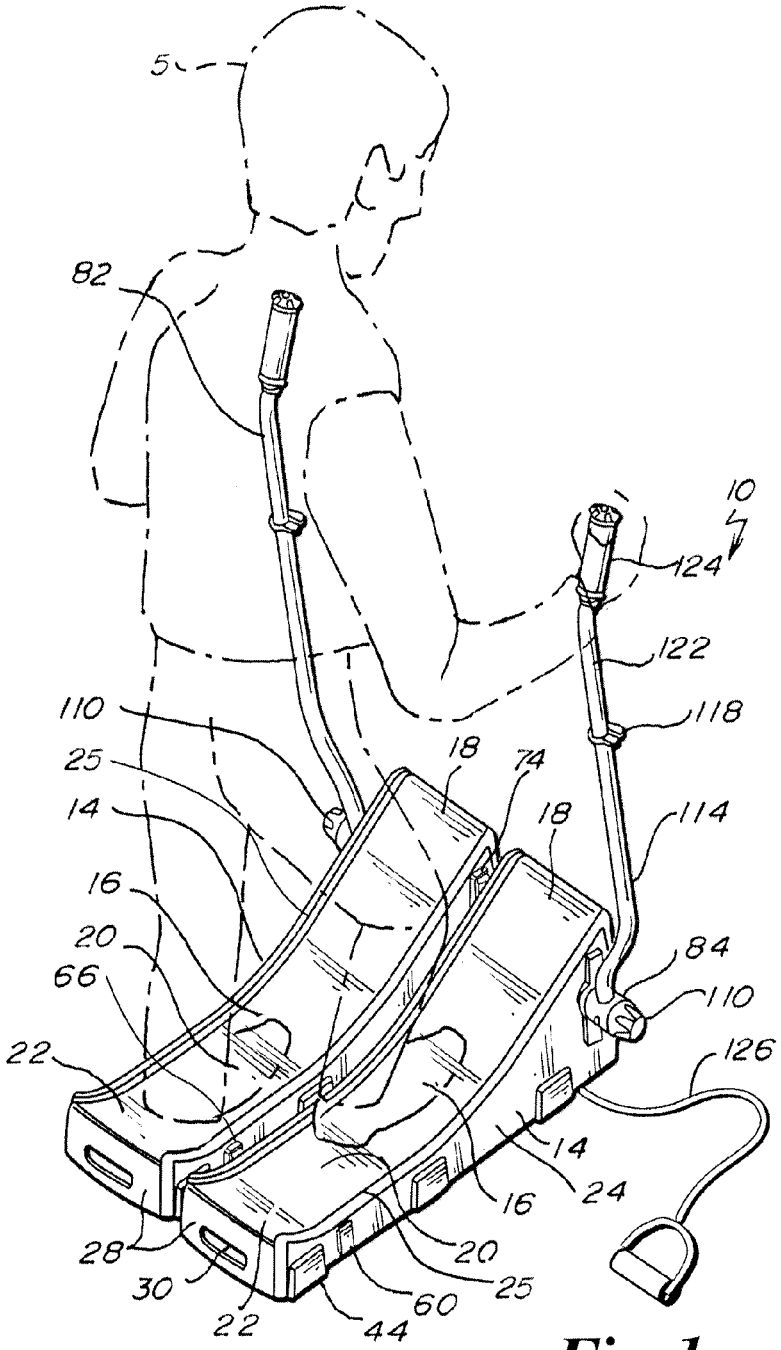
FIG. 1 is a rear perspective view of the assembled slide mill with a phantom person walking thereon in the forward direction of the slide mill.
Figure 2:
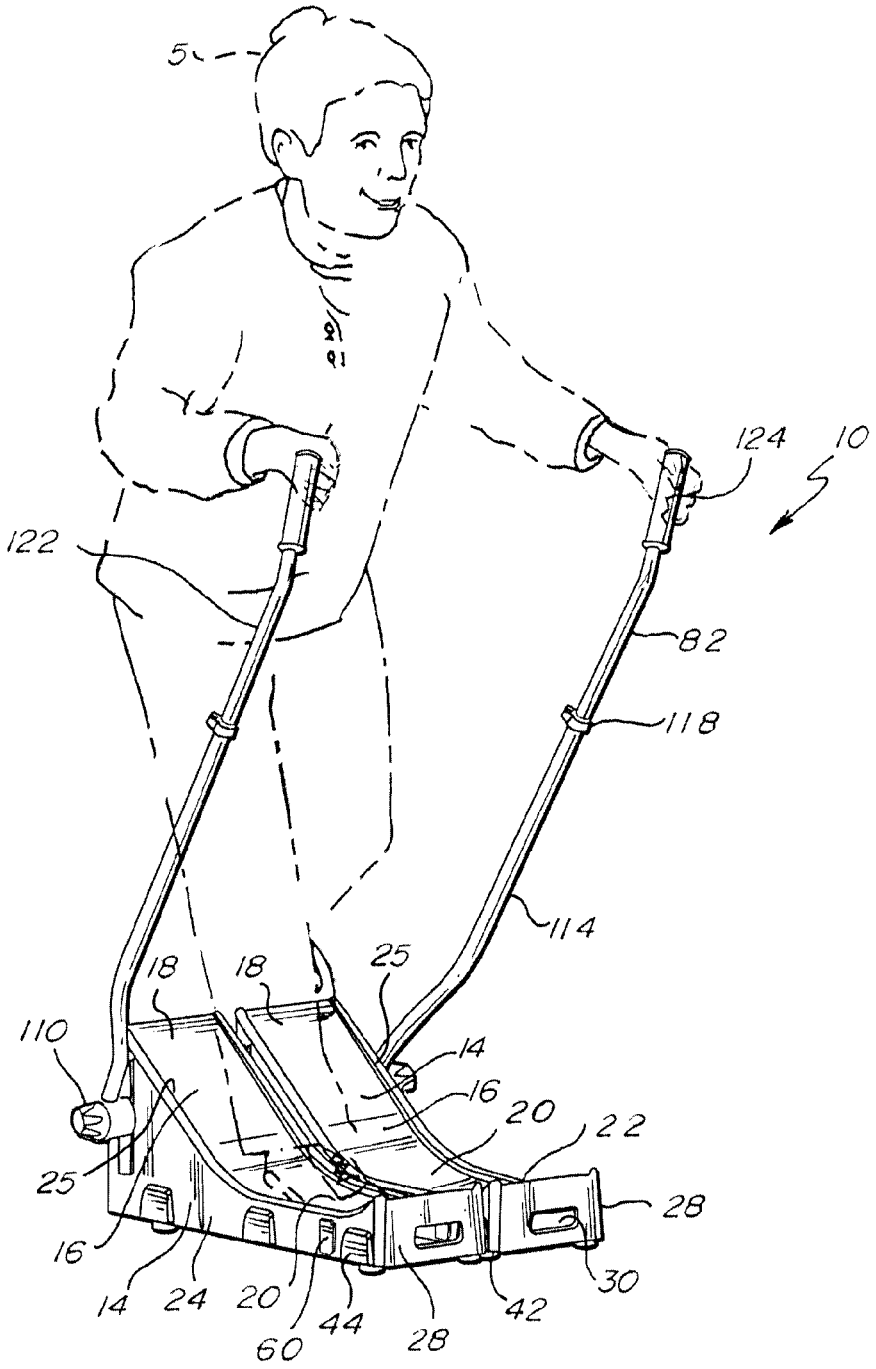
FIG. 2 is a front perspective view of the assembled slide mill with a phantom person walking thereon in the rear direction of the slide mill.

Referring to FIGS. 1 and 2, the slide mill 10 with a phantom person 5 exercising thereon generally includes two identical molded slide platforms 14 each with resilient feet 42 for vertical shock absorption. Each platform 14 has a foot sliding surface 16 comprised of a inclined front portion 18 and a shorter rear portion 22 which may be inclined or relatively flat. Adjustable, extendable and rotatable handle assemblies 82 are provided for the person to import some stability and exercise to the person's arms.

Details of the molded slide platforms 14 may be seen in FIGS. 1 thru 3A. the left and right plastic molded platforms are identical when molded. After the hardware is assembled on to two platforms 14, they are virtually mirror images of each other. Applicants contend a single platform 14, wider than as shown, could be used with this invention but would not have the significant advantage of disassembly. The molded slide platforms may be made of a variety of plastics such as high impact poly propylene (HIPP), styrene, ABS, nylon, polyethylene, etc. Molding of the platform 14 may be done by roto molding, blow molding or other methods.

Platform 14 has a foot sliding surface 16 that has a smooth polished-like finish including an inclined front surface 18, flat middle portion 20 and inclined rear portion 22. Rear portion 23 may also be relatively flat as shown in FIG. 3A. The front inclined portion is approximately 30° upward from horizontal and may range between 20° to 40°. The rear inclined portion is approximately 25° upward and may range between 15° to 35°. Most often, the person 5 on the slide mill 10 has his feet slide to and pickup from the flat middle portion 20. Hence, the rear portion 23 may be generally flat if desired. Synthetic socks optimally are worn over the feet or exercising shoes to assist in, and reduce friction in, exercising on the slide mill 10.

Platform 14 also has sidewalls 24 and side ridges 25 around the foot surface 16 to aid the person from not slipping off the slide mill 10 when exercising. Front wall 26 and rear wall 28 are provided. Name plate or advertising placard mounting opening is optionally provided in rear wall 28. Each sidewall 24 has rear cap or interlock mounting apertures 32 and forward interlock or handle mounting apertures 34 for hardware attachment described below. The underside 38 of platform 14 is substantially hollow to minimize platform weight while honeycomb or rib structure 40 add strength and reinforcement to the platform 14.

As to hardware assembly onto platforms 14, as generally seen in the figures, platforms 14 have shock absorbing feet 42 that mount into spring foot boxes 44 on each platform 14. Feet 42 provide resiliency, flexibility, recoil and shock absorption as a person 5 is exercising on the slide mill 10. Referring to FIG. 5, spring feet 42 include housing 46 with cut outs 47. Springs 48 are mounted on columns 50 of lower foot cap 52. Tabs 54 on cap 52 fit into cut outs 47 to assemble the spring feet 42. Once the spring feet 42 are aligned into platform foot boxes 44, screws 56 secure the foot assembly 42 into boxes 44 on platform 14. FIG. 5A shows alternatively that the feet assembly 42 may be a one piece foam foot 58 that secures into boxes 44 on platform 14.

Rear caps 60 with locking tabs 62 secure into the outbound sidewalls 24 of platforms 14 at mounting apertures in FIG. 5. On the inbound or inside of platform sidewalls 24, platform rear interlocks 66 with locking tabs 68 secure into interlock mounting apertures 32 as understood from FIGS. 5 and 6. The interlocks 66 each have complementary fingers 70 that interlock when adjacent platforms 14 are vertically lowered into horizontal alignment. Similarly, platform forward interlocks 74 secure into forward interlock apertures 34 with locking tabs 76 securing there into. Forward interlocks 74 have fingers 77 similarly to fingers 70 of the rear interlocks 66 that interlock with adjacent platform forward interlocks in the vertical lowering alignment of finger 70 and 77 when platforms 14 are vertically lowered into horizontal alignment. This fingers 70 and 77 interlocking arrangement may be clearly seen in FIGS. 4 and 10. By this arrangement, spring loaded feet 42, six per platform 14, provide vertical shock absorption as the exercising person 5 shifts their weight from foot to foot during walking, jogging or running.

Figure 7:
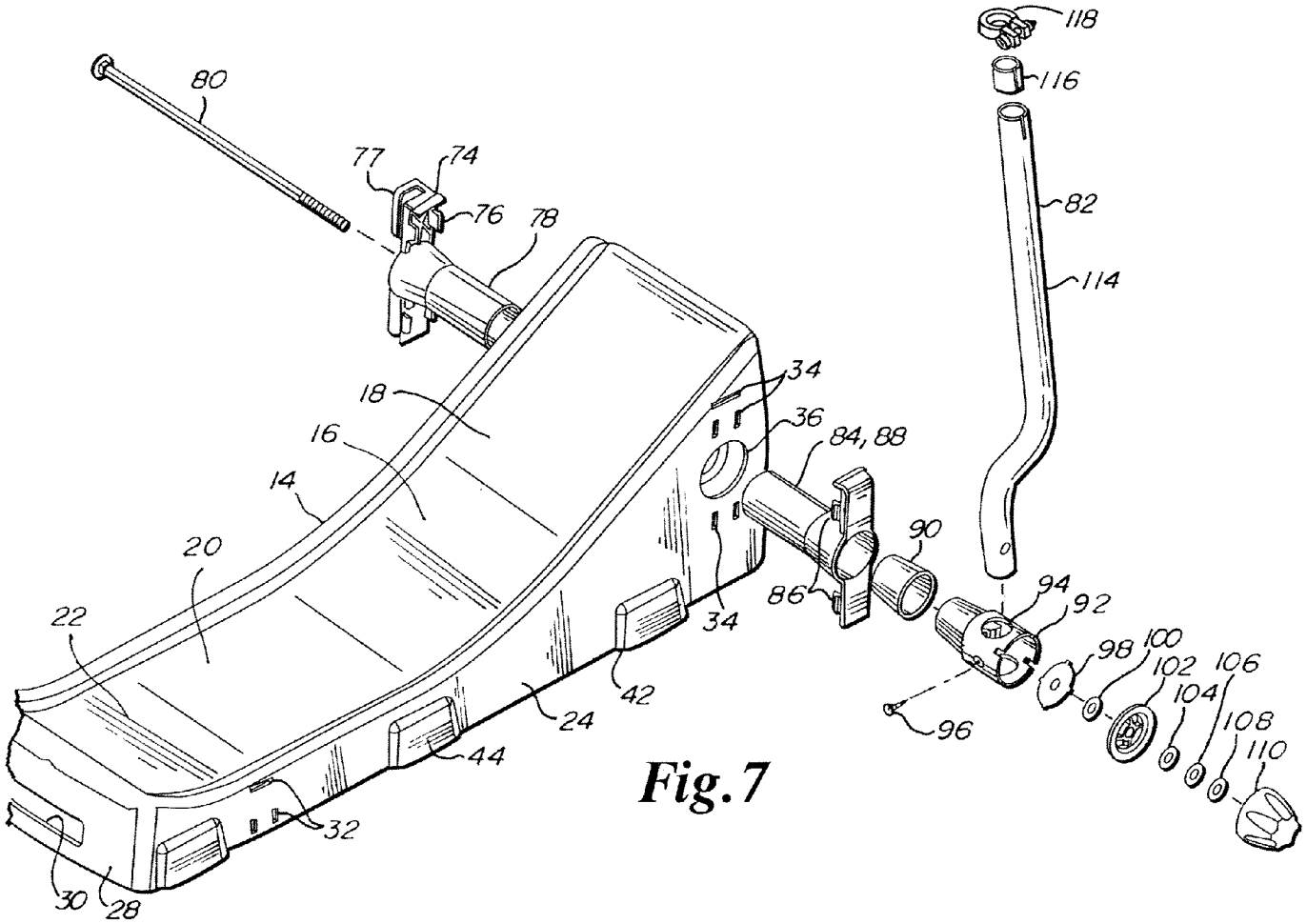
FIG. 7 is an exploded view of the handle assembly and forward interlock assembly in position for securement to the forward end of the right platform.

Referring to FIGS. 7 and 4, further details of forward interlocks 74 and their assembly into platform 14 and connection with handle assembly 82 may be appreciated. Again, forward interlocks secure into apertures 34 while tube section 78 slides into platform tube aperture 36 as to telescope with tube section 88 of handle pocket 84 with locking tabs 76 and 86 securing the forward interlock 74 and handle pocket 84 together and with platform 14. Next a tapered bushing 90 is inserted into handle pocket 84 while handle pivot body or block 92, with handle 82 inserted therein, is indexed into bushing 90. Tensioner bolt 80 is inserted through forward interlock 74, tubes 78 and 88, handle pivot body 92, handle 82 lower portion 114 and extends therefrom in an outward fashion. Next, wave spring pressure plate 98 is indexed on bolt 80 with wave spring 100 and pivot body end cap 102 thereto follow. Further flat washer 104, thrust bearing 106, flat washer 108 are fed onto bolt 80 followed by tensioner cap 110. Tensioner cap 110 can be tightened to adjust the resistance against handle 82 from rotation and shown in arrow C in FIG. 8. Tensioner cap 110 can also be loosened to allow the handles 82 to be folded downwardly adjacent platforms 14 for a storage position.

Lower handle tube section 114 at its upper end has plastic sleeve 116 inserted therein and quick release lever lock slid over the top end of lower handle tube section 114. Next, upper handle tube 122 is slid into sleeve 116 for a telescoping arrangement. The upper handle section may be extended or retracted to desired length and then the lever lock 118 is secured to fasten the desirably arranged length of handle 82. In place of handles 82, bungee cords 126 may be used with slide mill 10 as shown in FIG. 1. FIGS. 8 and 9 show both the outside and inside of assembled platform 14 with all its hardware.

Next, one platform 14 is lifted and the alignment of its inside sidewall 24 with the inside wall of the complementary (virtually mirrored) platform 14 is done as to align the respective rear interlocks 66 and forward interlocks 74. Then, the platform 14 is lowered to index interlock fingers 70 and 77 as shown in FIGS. 4 and 10. The platforms 14 are horizontally and in parallel with each other ready for use. The platforms 14 are not rigidly secured to each other. They can actually spring or move slightly up and down on feet 42 as a person 5 exercised on the slide mill 10.

Just before use, the length of handles 82 are adjusted to a comfortable length and secured by lever lock 118 or the like. The tensioner cap 110 is adjusted to the desired friction setting for the desired amount of resistive rotation for the arms of the user. The person 5, with synthetic socks or socks over shoes, then may stand on the slide mill 10. The person begins the exercising or walking condition with alternating feet being placed on the forward inclined surface portion 18 and dragged downwardly to generally the horizontal or flat middle portion 20 or further rearward to the inclined rear portion 22. At about this time, weight is being shifted and the other foot is placed up onto the inclined front portion 16 and this action is repeated. This effort places the person's quadriceps in concentric motion while the hamstrings are in eccentric motion.

Should the person wish to use the slide mill backwards (FIG. 2), the handles 82 may need additional adjustment. Walking on the slide mill 10 backwards toward the rear portion 22 the quadriceps are in eccentric motion while the hamstrings are in concentric motion. This is the same for other lower body muscle groups.

The above specification is for illustrative purposes only. The true scope of the present invention is defined in the following claims.

What is claimed:

1. A reversible walking slide mill platform for a person seeking walking or jogging exercise, comprising:

a) first and second, side by side, smooth slippery foot sliding surfaces, releaseably interlockable, one surface for each foot, each having an uphill inclined front surface of a certain height and a rear surface shorter than the front surface with a flat surface therebetween.

2. The slide mill platform of claim 1, further comprising resilient feet on a bottom of the platform as to provide shock absorption, flexibility and recoil to the platform when a person is exercising on the slide mill platform.

3. The slide mill platform of claim 1, further comprising a pair of extensible gripping handles mounted to the platform for gripping by the person during exercise.

4. The slide mill platform of claim 3 wherein the handles are adjustably resistive and rotatable.

5. The slide mill platform of claim 1 wherein the inclined front surface is at approximately 30° and the rear surface is inclined upwardly at approximately 25°.

6. The slide mill platform of claim 1 wherein the inclined front surface is in a range of 20° to 40° and the rear surface is inclined upwardly in a range of 15° to 35°.

7. The slide mill platform of claim 1, further comprising resilient feet on the bottom of the platforms as to provide vertical shock absorption, flexibility and recoil independently to each platform when a person is exercising on the slide mill platform.

8. The slide mill platform of claim 1, further comprising upward slide ridges on the foot sliding surface as to prevent the person from slipping off the slide mill platform.

9. The slide mill platform of claim 1 wherein the platform is molded of plastic.

10. A reversible walking slide mill for a person seeking walking or jogging exercise, comprising:

a) first and second molded plastic slide mill platforms horizontally interlockable to each other in side by side arrangement as for one platform for each person's foot, the platforms being disconnectable as to reduce width when in storage or transportation; and b) smooth slippery foot sliding surface on each platform having an uphill inclined front surface and a rear surface shorter than the front surface with a flat surface therebetween.

11. The slide mill of claim 10 wherein the front foot sliding surface is approximately two-thirds taller than the flat portion.

12. The slide mill of claim 10, further comprising a pair of extensible gripping handle mounted to each of the platforms for gripping by the person during exercise.

13. The slide mill platform of claim 12 wherein the handles are adjustably resistive and rotatable.

14. The slide mill of claim 10 wherein the inclined front surface is at approximately 30° and the rear surface is inclined upwardly at approximately 25°.

15. The slide mill of claim 10 wherein the inclined front surface is in a range of 20° to 40° and the rear surface is inclined upwardly in a range of 15° to 35°.

16. The slide mill platform of claim 10, further comprising resilient feet on the bottom of the platforms as to provide vertical shock absorption, flexibility and recoil independently to each platform when a person is exercising on the slide mill platform.

17. The slide mill platform of claim 10, further comprising upward slide ridges on the foot sliding surfaces as to prevent the person from slipping off the slide mill platform.

18. A reversible walking slide mill for a person seeking walking or jogging exercise, comprising:

a) first and second molded slide mill platforms horizontally interlockable to each other in side by side arrangement as for one platform for each person's foot, the platforms being disconnectable as to reduce width when in storage or transportation;

b) smooth slippery foot sliding surface on each platform having an uphill inclined front surface and a rear surface shorter than the front surface with a flat surface therebetween; and c) a pair of extensible gripping handle mounted to each of the platforms for gripping by the person during exercise.

19. The slide mill platform of claim 18 wherein the handles are adjustably resistive and rotatable.

20. The slide mill of claim 18 wherein the inclined front surface is at approximately 30° and the rear surface is inclined upwardly at approximately 25°.

21. The slide mill of claim 18 wherein the inclined front surface is in a range of 20° to 40° and the rear surface is inclined upwardly in a range of 15° to 35°.

22. The slide mill platform of claim 18, further comprising resilient feet on the bottom of the platforms as to provide vertical shock absorption, flexibility and recoil independently to each platform when a person is exercising on the slide mill platform.

23. The slide mill platform of claim 18, further comprising upward slide ridges on the foot sliding surfaces as to prevent the person from slipping off the slide mill platform.

24. A reversible walking slide mill for a person seeking walking or jogging exercise, comprising:

a) first and second plastic molded slide mill platforms horizontally interlockable to each other in side by side arrangement as for one platform for each person's foot, the platforms being disconnectable as to reduce width when in storage or transportation;

b) smooth slippery foot sliding surface on each platform having an uphill inclined front surface and a rear surface shorter than the front surface with a fiat surface therebetween;

c) a pair of extensible gripping handle mounted to each of the platforms for gripping by the person during exercise; and d) resilient feet on the bottom of the platforms as to provide vertical shock absorption, flexibility and recoil independently to each platform when a person is exercising on the slide mill platform.

25. The slide mill platform of claim 24 wherein the handles are adjustably resistive and rotatable.

26. The slide mill of claim 24 wherein the inclined front surface is at approximately 30° and the rear surface is inclined upwardly at approximately 25°.

27. The slide mill of claim 24 wherein the inclined front surface is in a range of 20° to 40° and the rear surface is inclined upwardly in a range of 15° to 35°.

28. The slide mill platform of claim 24, further comprising upward slide ridges on the foot sliding surfaces as to prevent the person from slipping off the slide mill platform.

29. The slide mill of claim 24 wherein the front foot sliding surface is approximately two-thirds taller than the flat portion.

* * * * *